US008955272B1

(12) United States Patent
Underkofler et al.

(10) Patent No.: US 8,955,272 B1
(45) Date of Patent: Feb. 17, 2015

(54) ACCESSIBLE STABILIZER BAR

(71) Applicant: USG Interiors, LLC, Chicago, IL (US)

(72) Inventors: Abraham M. Underkofler, Waukegan, IL (US); Peder J. Gulbrandsen, Aurora, IL (US); Mark R. Paulsen, Beach Park, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/953,928

(22) Filed: Jul. 30, 2013

(51) Int. Cl.
*E04C 2/52* (2006.01)
*E04B 9/06* (2006.01)

(52) U.S. Cl.
CPC ..... *E04B 9/067* (2013.01)
USPC ..... 52/220.6; 52/506.06

(58) Field of Classification Search
USPC ..... 52/220.6, 506.06, 506.07, 506.08, 52/506.09, 506.1
See application file for complete search history.

(56) References Cited

U.S. PATENT DOCUMENTS

| | | | | | |
|---|---|---|---|---|---|
| 60,294 | A | * | 12/1866 | Walker | 202/270 |
| 2,667,667 | A | * | 2/1954 | Jacobson | 52/506.06 |
| 3,142,367 | A | * | 7/1964 | Brown et al. | 52/506.07 |
| 3,640,042 | A | * | 2/1972 | Kidney | 52/506.09 |
| 4,064,671 | A | | 12/1977 | Sauer | |
| 4,364,215 | A | * | 12/1982 | Gailey et al. | 52/506.08 |
| 4,426,822 | A | * | 1/1984 | Gailey | 52/669 |
| 4,660,348 | A | * | 4/1987 | LaLonde | 52/506.08 |
| 4,757,663 | A | * | 7/1988 | Kuhr | 52/481.1 |
| 4,991,373 | A | * | 2/1991 | Shaub | 52/715 |
| 5,363,622 | A | * | 11/1994 | Sauer | 52/506.07 |
| 6,047,517 | A | * | 4/2000 | Vrame | 52/506.06 |
| 6,374,564 | B1 | * | 4/2002 | Fletterick et al. | 52/506.07 |
| 6,446,406 | B1 | * | 9/2002 | Sauer | 52/506.06 |
| 7,010,894 | B1 | * | 3/2006 | Cappelle | 52/480 |
| 7,392,629 | B1 | * | 7/2008 | Bankston et al. | 52/506.07 |
| 7,398,623 | B2 | * | 7/2008 | Martel et al. | 52/489.2 |
| 7,634,881 | B2 | * | 12/2009 | Ahren et al. | 52/506.06 |
| 7,658,047 | B2 | * | 2/2010 | Bankston et al. | 52/506.07 |
| 7,712,274 | B2 | * | 5/2010 | Wendt et al. | 52/506.07 |
| 8,209,931 | B2 | * | 7/2012 | Sareyka | 52/506.06 |
| 8,596,009 | B2 | * | 12/2013 | Baxter et al. | 52/506.06 |
| 8,640,408 | B2 | * | 2/2014 | Wilkens | 52/220.6 |
| 2004/0118068 | A1 | * | 6/2004 | Kliegle et al. | 52/483.1 |
| 2006/0101744 | A1 | * | 5/2006 | Falbaum et al. | 52/238.1 |
| 2008/0184644 | A1 | * | 8/2008 | Bankston et al. | 52/506.06 |
| 2009/0094924 | A1 | * | 4/2009 | Paul et al. | 52/506.07 |
| 2010/0050554 | A1 | * | 3/2010 | Ahren et al. | 52/506.06 |
| 2010/0095627 | A1 | * | 4/2010 | Meres et al. | 52/506.07 |
| 2011/0067337 | A1 | * | 3/2011 | Jahn et al. | 52/506.09 |
| 2012/0159890 | A1 | * | 6/2012 | Wilkens | 52/506.06 |

* cited by examiner

*Primary Examiner* — William Gilbert
*Assistant Examiner* — Gisele Ford
(74) *Attorney, Agent, or Firm* — Pearne & Gordon LLP

(57) ABSTRACT

An elongated stabilizer bar for maintaining a pair of grid runners in parallel upright positions to support a panel on respective grid runner support surfaces, the stabilizer bar having a horizontal leg and a vertical leg, the horizontal leg having self-penetrating tabs arranged to pierce and thereby grip a core of the panel to fix the stabilizer bar to the panel, a vertical leg having a vertical slot at each end, the slot having an open bottom, the slot having a horizontal width adapted to receive and confine an upper reinforcing bulb of a respective one of the pair of grid runners to thereby restrain the respective grid runner against excessive bowing and twisting deflection.

13 Claims, 2 Drawing Sheets

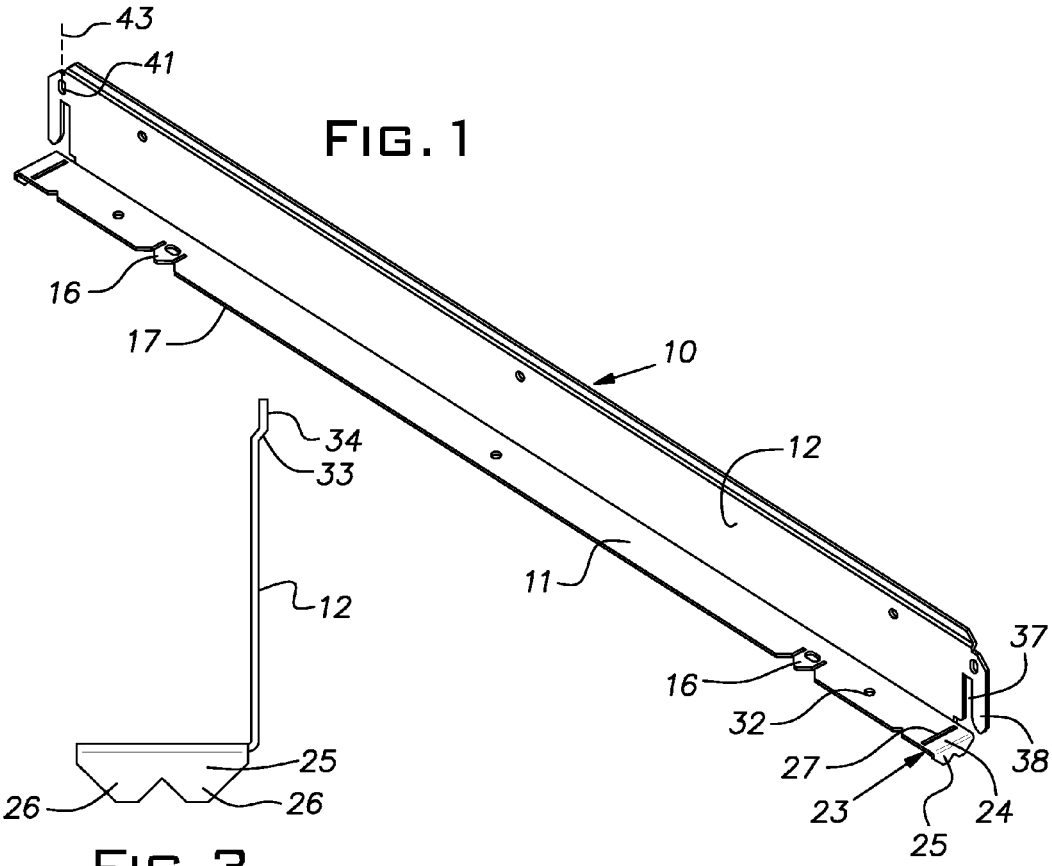
FIG. 1
FIG. 3
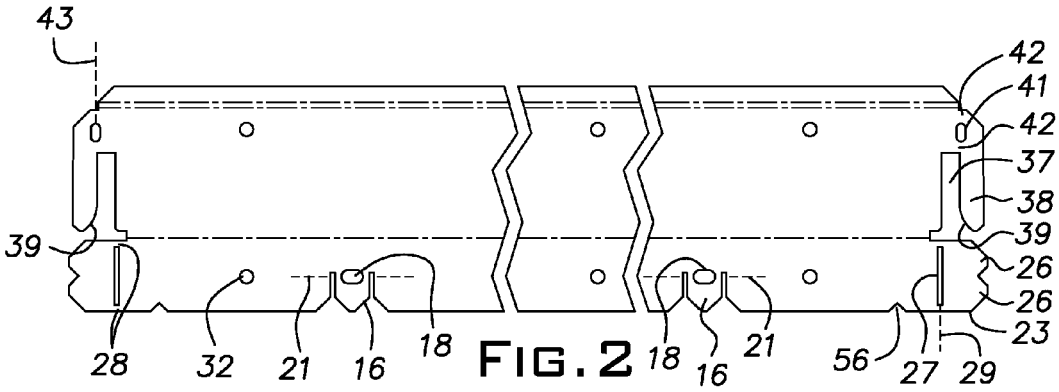
FIG. 2

ACCESSIBLE STABILIZER BAR

BACKGROUND OF THE INVENTION

The invention relates to suspended ceiling construction and, in particular, to a device for stabilizing relatively long grid openings.

PRIOR ART

Suspended ceiling grid design has evolved to arrangements where the grid modules or openings are commonly 2 foot by 4 foot or 2 foot by 2 foot (or metric equivalents). Accordingly, the grid members are designed with a geometry and material content to withstand the forces present in these now common grid module sizes.

In recent times, there has developed a demand for larger panels than these common sizes. This presents a problem because the grid elements, typically tees, can bend and/or twist under the panel weight or other imposed loading. Deflection of a grid element for a given force is exponential with its unrestrained length and twisting is proportional to its length. It follows that a grid element having a standard construction but with an unusually long unrestrained length, can deflect and/or twist beyond normal limits. When a grid element deflects from its intended position, the associated edge of a panel can slip off the element. This results in an unsightly appearance or, worse, the panel can fall off the grid.

Stabilizer bars have been available to maintain a pair of grid elements in their desired positions. An example of a prior art stabilizer bar is disclosed in U.S. Pat. No. 4,064,671. A typical prior art stabilizer bar in a completed ceiling installation cannot be ordinarily relocated to a functional position after an underlying panel has been raised to gain access to the plenum above the ceiling. There is no practical way of reinstalling stabilizer bars where the adjacent panels on both sides of the removed panel are in place. Accordingly, there has existed a need for a stabilizer bar arrangement that can be reinstalled after the panel beneath it is raised for access and then reset in a ceiling grid module.

SUMMARY OF THE INVENTION

The invention provides a stabilizer bar for a suspended ceiling grid that is reinstallable after its removal for access to the plenum above the ceiling. The stabilizer bar, in accordance with the invention, is rigidly affixed to the rear side of the ceiling panel and is arranged to engage a pair of parallel spaced grid runners when the panel is lowered into place.

A hook structure at each end of the stabilizer bar is proportioned to laterally restrain an associated grid member. The hook structure engages opposite sides of a reinforcing bulb of a respective grid runner. As a result, the respective grid runner is restrained from excessive bowing and/or tilting which could otherwise result with an edge of an associated panel free to sag or drop from the grid.

In the disclosed embodiment, the stabilizer bar is provided with integral tabs for penetrating and locking onto the body or core of an associated acoustical panel. Alternatively, the stabilizer bar has provisions for being fixed with screws or like fasteners to a wood or other dense composite panel.

BRIEF DESCRIPTION OF THE DRAWINGS

FIG. 1 is an isometric view of a stabilizer bar constructed in accordance with the invention;

FIG. 2 is a plan view of a blank or stamping from which the stabilizer bar of FIG. 1 is formed;

FIG. 3 is an end view of the stabilizer bar;

DESCRIPTION OF THE PREFERRED EMBODIMENT

Figure 4:
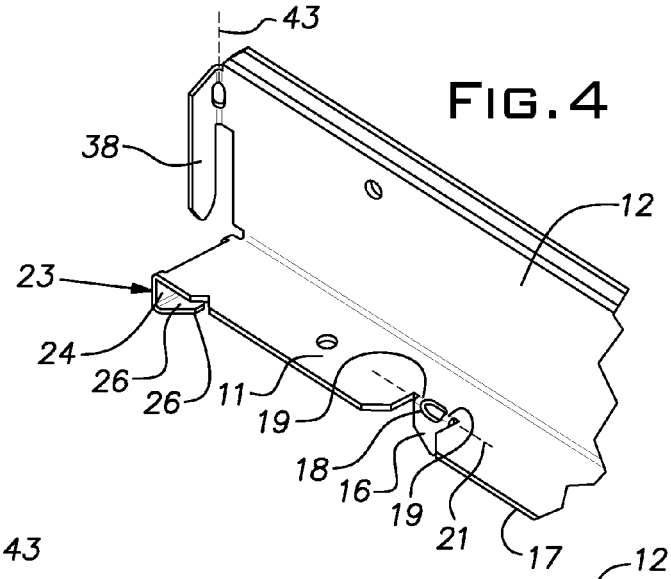
FIG. 4 is a fragmentary isometric view of the stabilizer bar showing the deployed positions of a stab tab, a capture tab, and a folded bulb hook.

A stabilizer bar 10 shown in FIG. 1 is an elongated sheet metal body formed with a right angle cross-section. The stabilizer bar 10 can be made of a suitable malleable metal such as, for example, 21 gauge hot dipped galvanized steel. The stabilizer bar, for example, can have nominal lengths of 24 inches, 30 inches, and 48 inches or metric industry substitutes for these dimensions depending on the application. The stabilizer bar 10 is symmetrical about its mid-length. The stabilizer bar 10 includes a horizontal leg 11 and a vertical leg 12, both of which are generally planar allowing a plurality of stabilizer bars to be nested for shipping purposes. The horizontal leg 11 has a pair of integral stab tabs 16 stamped or otherwise cut into its body at locations spaced from the leg ends along a free or distal longitudinal edge 17. With particular reference to FIG. 2, showing the profile of the legs 11 and 12, the tabs 16 are somewhat pointed adjacent the line of the distal edge 17. A hole 18 in the leg 11 at the base of a tab 16 leaves two land areas 19 connecting the tab to the leg proper. The hole 18 forms a line of weakness 21 parallel to the length of the stabilizer bar 10. At each end of the stabilizer bar 10, the horizontal leg 11 is formed with an integral capture tab 23. Preferably, the capture tab 23, in the form of the stabilizer bar as it is shipped from the manufacturing site, has a proximal portion 24 in the plane of the horizontal leg 11 and a distal depending portion 25 in a plane at right angles to the plane of the horizontal leg. The distal portion 25 is in the form of a pair of truncated or blunted triangular barbs 26.

A through slot 27 transverse to the length of the stabilizer bar 10 leaves a pair of spaced lands 28 joining the capture tab 23 to the horizontal leg proper and forms a transverse line of weakness 29 between the horizontal leg proper and the capture tab 23. A plurality of through holes 32 are spaced along the length of the horizontal leg, preferably midway between the edge 17 and the vertical leg 12.

As shown in FIG. 3, the vertical leg 11 is stiffened at its upper edge by an integral offset formed by an oblique narrow band 33 and a vertical distal strip 34. Each end of the vertical leg 12 includes a vertical slot 37 open at the bottom and forming an integral vertical depending hook 38. A free end of the hook 38 has a beveled edge 39 leading to the slot 37. A juncture of the hook 38 with the vertical leg proper is interrupted by a small through vertical slot 41 that leaves a pair of land areas 42 and forming a vertical line of weakness 43 in the juncture.

The selected length of the stabilizer bar will correspond to the nominal spacing of a pair of main tees on which the stabilizer bar 10 is ultimately mounted. One or two stabilizer bars 10 can be used on a ceiling panel, depending on the length of the panel. Ordinarily, where one is used, it is located at mid-length of the panel; when two are used on longer panels, they are located from an end of the panel at ⅓ and ⅔ of the panel length.

Figure 5:
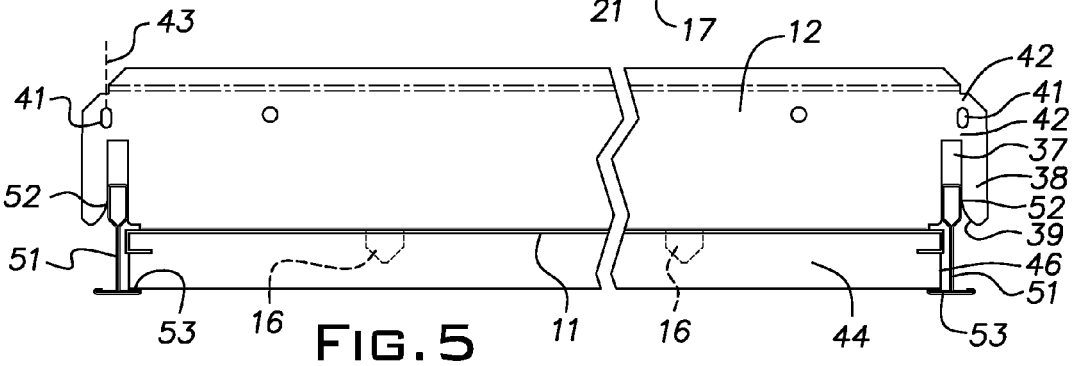
FIG. 5 is an elevational view of the stabilizer bar fixed as an assembly on a ceiling panel with the assembly installed on a pair of parallel grid runners.

The stabilizer bar 10 can be fixed on the back side of an acoustical ceiling panel or tile of a low density type using the integral tabs 16 and 23. The final position of a stabilizer bar on a panel is illustrated in FIG. 3, but their mutual assembly is accomplished before they are mounted on the ceiling grid. First, the stab tabs 16 are manually bent down 90 degrees to a vertical orientation, typically by the person installing a ceiling panel 44. The land areas 19 bend at the line of weakness 21. Thereafter, the stabilizer bar 10 is laterally symmetrically located on the panel 44 so that the slots 37 are both outward of long edges 46 of the panel 44 as shown in FIG. 5. Then, the stabilizer bar 10 is pressed downward to drive the stab tabs 16 into the core of the panel 44 until the lower face of the horizontal leg 11 abuts the backside of the panel 44. Next, the capture tabs 23 are deployed by bending them so that the barbs 26 are driven into the vertical surfaces 46 of the respective edges of the panel 44. The capture tab 23 hinges about the line 29 so that the proximal part 24 of the tab 23 can be folded tightly against the edge surface 46 while the barbs 26 are driven with a horizontal movement component into the core of the panel 44.

With the stab tabs 16 and capture tabs 23 deployed as described, the stabilizer bar 10 is fixed on the panel 44. The assembly of the panel 44 and stabilizer bar 10 or stabilizer bars is ordinarily installed on a grid by first manipulating the assembly through a grid opening from below much the same way an ordinary panel without a stabilizer bar is manipulated. The suspended ceiling grid is represented by a pair of parallel spaced grid runners or tees 51 illustrated in FIG. 5. The grid runners 51 are spaced in parallel relation at, typically, the nominal dimensions recited above in the description of normally available stabilizer bars 10. The panel and stabilizer bar assembly is aligned so that it overlies a grid module and is then lowered into place.

The beveled edges 39 on the hooks 38 afford a centering action to bring the panel and stabilizer bar assembly into lateral registration with the grid tees 51. As the assembly is lowered, reinforcing bulbs 52 of the grid runners 51 enter respective slots 37 in the stabilizer bar vertical leg 12. The width of a slot 37 is dimensioned with a moderately loose fit relative to the width of a reinforcing bulb 52 to allow the bulb to freely slide into the slot but to not allow appreciable lateral movement of the bulb. The vertical dimension of the slot 37 is large in comparison to the height of the bulb 52, in a normal range of panel thickness, so that a clearance will exist between the stabilizer bar and the top of the bulb. The hook 38 can be manually bent towards the associated bulb 52 at the line 43 to reduce interference with installation or removal of a panel in the adjacent grid module.

With the panel 44 resting on flanges 53 of the grid runners 51, the reinforcing bulbs 52 are constrained in both lateral directions by the sides of the respective slots 37. Consequently, the grid runners 51 are restrained from significant lateral bowing and/or twisting about their longitudinal axii. Therefore, the risk that the edge of a panel 44 can slip off a flange 53, deflected by the weight of a long panel or other force, is greatly reduced, if not eliminated.

The inventive stabilizer bar has the advantage of allowing the panel 44 to which it is fixed to be lifted for access to the plenum above the grid and permits it to be reinstalled in the same manner as it was initially installed.

Figure 6:
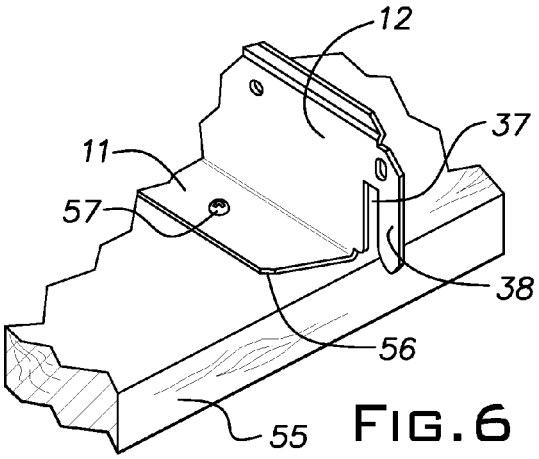
FIG. 6 is a fragmentary isometric view of the stabilizer bar modified and fixed on a high density panel.

The stabilizer bar can be modified by the technician installing it for use with wood or other dense core panels or tiles. A small reference notch 56 exists in the horizontal leg edge 17 adjacent each end of the leg 11. A diagonal cut with a tin snips or the like is made from the notch 56 to the end of the horizontal leg 11 to sever the capture tab 23 from the stabilizer bar. The stab tabs 16 are not bent out of the plane of the horizontal leg 11. As illustrated in FIG. 6, the stabilizer bar 10 is located on the back of a dense panel substantially as described above. Short screws 57 are assembled in the holes 32 and driven into the panel core to fix the modified stabilizer bar to the panel.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An elongated stabilizer bar for maintaining a pair of grid runners in parallel upright positions to support a panel on respective grid runner support surfaces, the stabilizer bar having a horizontal leg and a vertical leg, the horizontal leg having self-penetrating tabs arranged to pierce and thereby grip a core of the panel to fix the stabilizer bar to the panel, the vertical leg having a vertical slot at each end, the slot having an open bottom, the slot having a horizontal width adapted to receive and confine an upper reinforcing bulb of a respective one of the pair of grid runners in an installed position to thereby restrain the respective grid runner against excessive bowing and twisting deflection and permit the stabilizer bar and panel to be freely and simultaneously lifted from respective installed positions for access to a space above the grid runners.

2. A stabilizer bar as set forth in claim 1, comprising a sheet metal body.

3. A stabilizer bar as set forth in claim 2, wherein said body has a generally right angle configuration.

4. A stabilizer bar as set forth in claim 2, wherein said tabs are cut out from respective parts of the sheet metal body.

5. A stabilizer bar as set forth in claim 1, wherein said tabs include generally vertically depending tabs.

6. A stabilizer bar as set forth in claim 1, wherein said tabs include tabs that are adapted to engage vertical edges of a panel overlying the support surfaces of the grid runners.

7. A stabilizer bar as set forth in claim 1, wherein said tabs are deployable by manual force applied by a person installing the stabilizer bar on a panel.

8. A stabilizer bar as set forth in claim 7, wherein said tabs are joined to a horizontal leg at respective lines of weakness.

9. A stabilizer bar as set forth in claim 8, wherein the lines of weakness are determined by a through hole disposed between a tab and the horizontal leg.

10. A stabilizer bar as set forth in claim 6, wherein the vertical edge tabs have a construction that enables a portion thereof to pierce a panel edge with a horizontal component of motion.

11. A stabilizer bar as set forth in claim 10, wherein said horizontal leg includes holes dimensioned to accept screws to fix the stabilizer bar to a high density board.

12. In a suspended ceiling, a pair of parallel grid runners, the grid runners having panel supporting surfaces and reinforcing bulbs above the supporting surfaces, a panel extending horizontally between said grid runners and carried on the supporting surfaces, an elongated rigid stabilizer bar fixed directly to a rear upper face of the panel transversely of said grid runners, the stabilizer bar having a vertical slot at each end thereof, the slots having a configuration to slip over a respective reinforcing bulb when the panel is lowered from an elevation above said support surfaces onto said support surfaces, the slot configuration when the panel is supported on said support surfaces laterally confining the respective reinforcing bulb in both lateral directions and permitting the panel to be raised for access to a plenum above the ceiling and then be reinstalled without separation of the stabilizer bar from the panel.

13. A method of stabilizing the grid runners of a suspended ceiling so that access to a space above the ceiling is available and subsequent loss of a stabilizing function is avoided comprising the steps of providing an elongated metal stabilizer bar with integral fastening tabs at least some of which are deployable by manual bending and penetration into a core of an acoustical panel to fix the stabilizer bar to the panel and with open bottom slots at each end for closely laterally fitting opposite sides of a reinforcing bulb of a respective grid runner and capable of receiving the bulb when the panel to which the stabilizer bar is fixed is lowered onto panel supporting surfaces of the grid runners.

* * * * *